US009311867B2

(12) United States Patent
Youn et al.

(10) Patent No.: US 9,311,867 B2
(45) Date of Patent: Apr. 12, 2016

(54) DEVICES AND METHODS FOR REDUCING POWER CONSUMPTION OF A DEMULTIPLEXER

(71) Applicant: APPLE INC., Cupertino, CA (US)

(72) Inventors: Sang Y. Youn, Cupertino, CA (US); Hopil Bae, Sunnyvale, CA (US); David A. Stronks, San Jose, CA (US); Kingsuk Brahma, San Francisco, CA (US); Taif A. Syed, Toronto (CA)

(73) Assignee: Apple Inc., Cupertino, CA (US)

( * ) Notice: Subject to any disclaimer, the term of this patent is extended or adjusted under 35 U.S.C. 154(b) by 233 days.

(21) Appl. No.: 13/890,928

(22) Filed: May 9, 2013

(65) Prior Publication Data

US 2014/0132585 A1 May 15, 2014

Related U.S. Application Data

(60) Provisional application No. 61/725,806, filed on Nov. 13, 2012.

(51) Int. Cl.
*G09G 3/36* (2006.01)

(52) U.S. Cl.
CPC ..... *G09G 3/3611* (2013.01); *G09G 2310/0297* (2013.01); *G09G 2330/021* (2013.01)

(58) Field of Classification Search
CPC ..... G09G 3/22; G09G 3/3208; G09G 3/30; G09G 3/3225; G09G 3/3233; G09G 3/3241; G09G 3/3266; G09G 3/3275; G09G 3/3258
See application file for complete search history.

(56) References Cited

U.S. PATENT DOCUMENTS 5,978,366 A 11/1999 Massingill et al.
6,124,840 A * 9/2000 Kwon ..... G09G 3/3677 345/100
6,404,264 B2 6/2002 Daniel et al.
7,715,886 B2 5/2010 Kanno et al.
7,982,501 B2 * 7/2011 Lewis ..... H03K 17/08122 326/68
8,169,396 B2 * 5/2012 Chiang ..... G09G 3/3688 345/99
8,248,290 B2 8/2012 Payne
8,363,635 B2 1/2013 Liu
8,405,425 B2 3/2013 Lewis
2005/0270257 A1 * 12/2005 Shin ..... G09G 3/3275 345/76
2006/0290638 A1 * 12/2006 Kang ..... G09G 3/2011 345/98
2007/0182693 A1 * 8/2007 Kwon ..... G09G 3/2011 345/100
2007/0200815 A1 * 8/2007 Yeh ..... G09G 3/3688 345/98
2007/0296661 A1 * 12/2007 Ishiguchi ..... G09G 3/3688 345/87
2008/0150852 A1 * 6/2008 Edwards ..... G09G 3/3648 345/87
2009/0174649 A1 * 7/2009 Kim ..... G09G 3/3688 345/104

(Continued)

*Primary Examiner* — Kent Chang
*Assistant Examiner* — William Lu
(74) *Attorney, Agent, or Firm* — Fletcher Yoder PC

(57) ABSTRACT

The present disclosure relates to devices and methods for reducing power consumption of a display. One electronic display includes a first switch coupled between a first gate of a first transistor and a second gate of a second transistor to selectively connect the first gate to the second gate. The display includes a second switch coupled between the second gate of the second transistor and a third gate of a third transistor to selectively connect the second gate to the third gate. The display also includes driving circuitry that controls the first switch to connect the first gate to the second gate to share a first charge between the first and second gates. The driving circuitry also controls the second switch to connect the second gate to the third gate to share a second charge between the second and third gates. Accordingly, power consumption of the display may be reduced.

19 Claims, 10 Drawing Sheets

(56) References Cited

U.S. PATENT DOCUMENTS

2010/0265234 A1* 10/2010 Fukuo ..... G09G 3/3614 345/211
2012/0169690 A1* 7/2012 Sasaki ..... G09G 3/3659 345/209
2012/0169750 A1* 7/2012 Murakami ..... G09G 3/3659 345/531
2012/0269238 A1* 10/2012 Fujimura ..... H03H 17/0266 375/211
2013/0119412 A1* 5/2013 Kasai ..... G09G 3/3233 257/88

* cited by examiner

DEVICES AND METHODS FOR REDUCING POWER CONSUMPTION OF A DEMULTIPLEXER

CROSS REFERENCE TO RELATED APPLICATIONS

This application is a Non-Provisional Application of U.S. Provisional Patent Application No. 61/725,806, entitled "Devices and Methods for Reducing Power Consumption of a Demultiplexer", filed Nov. 13, 2012, which is herein incorporated by reference.

BACKGROUND

The present disclosure relates generally to electronic displays and, more particularly, to reducing power consumption of a demultiplexer of a display.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays, such as liquid crystal displays (LCDs) or organic light emitting diode (OLED) displays, are commonly used in electronic devices such as televisions, computers, and handheld devices (e.g., cellular telephones, audio and video players, gaming systems, and so forth). Such display devices typically provide a flat display in a relatively thin package that is suitable for use in a variety of electronic goods. In addition, such display devices typically use less power than comparable display technologies, making them suitable for use in battery-powered devices or in other contexts where it is desirable to minimize power usage.

LCDs typically include an LCD panel having, among other things, a liquid crystal layer and various circuitry for controlling orientation of liquid crystals within the layer to modulate an amount of light passing through the LCD panel and thereby render images on the panel. The LCD may include a demultiplexer to facilitate sharing of each output from the LCD driving circuitry with multiple data lines of the LCD panel. For example, each output from the LCD driving circuitry may be used to provide pixel data to three data lines of the LCD panel. The demultiplexer may include multiple switches, such as thin-film transistors (TFTs), to alternate which of the data lines each output from the LCD driving circuitry is electrically connected to. OLED displays may also include a demultiplexer with multiple switches, such as TFTs, to alternate which of the data lines receive output from driving circuitry. Unfortunately, the TFTs in either type of display may be activated using a high gate voltage resulting in large voltage swings when alternating between activating and deactivating the gate. Therefore, the demultiplexer may consume a substantial amount of power. Accordingly, there is a need for low power techniques that decrease the amount of power consumed by a demultiplexer, and thereby decreasing the amount of power consumed by an electronic display.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to various techniques, systems, devices, and methods for reducing power consumption of a display. Accordingly, a demultiplexer of the display may include multiple thin-film transistors (TFTs) with gates that are activated using driving circuitry. Certain gates of the TFTs may be selectively coupled together during operation of the demultiplexer to facilitate charge sharing between the gates to reduce power consumption of the demultiplexer, and thereby reduce power consumption of the display. For example, one electronic display includes a demultiplexer having a first transistor, a second transistor, and a third transistor. The display also includes a first switch coupled between a first gate of the first transistor and a second gate of the second transistor. The first switch may be used to selectively connect the first gate to the second gate. The display includes a second switch coupled between the second gate of the second transistor and a third gate of the third transistor. The second switch may be used to selectively connect the second gate to the third gate. The display also includes driving circuitry that controls the first switch to connect the first gate to the second gate to share a first charge stored on the first gate with the second gate. The driving circuitry also controls the second switch to connect the second gate to the third gate to share a second charge stored on the second gate with the third gate. Accordingly, power consumption of the display may be reduced.

Various refinements of the features noted above may be made in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Figure 1:
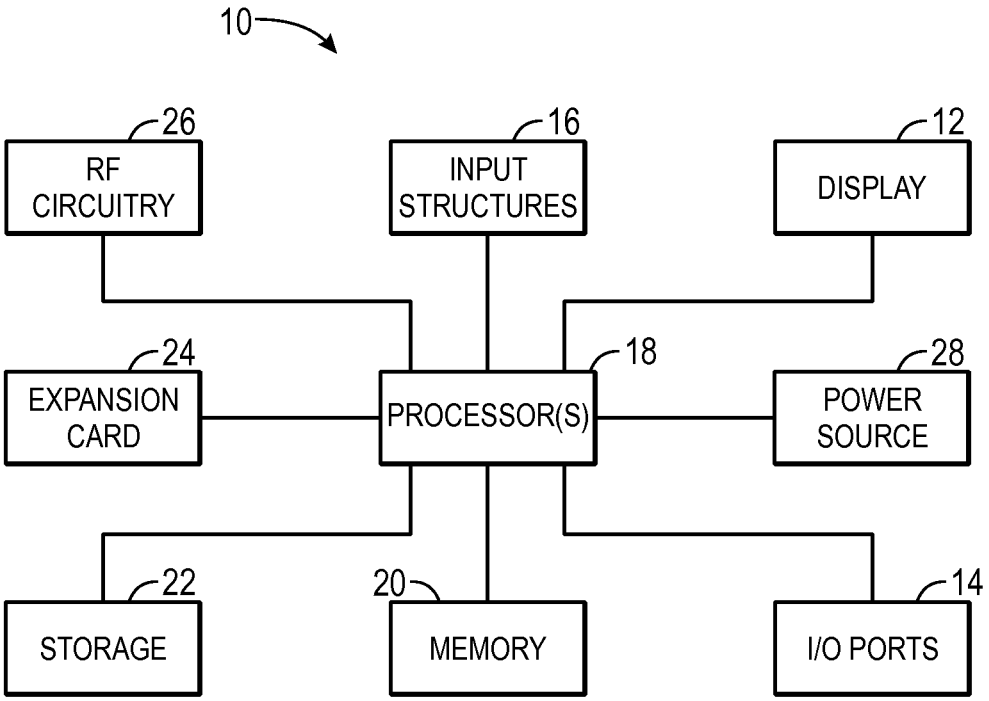
FIG. 1 illustrates a block diagram of an electronic device that may use the techniques disclosed herein, in accordance with aspects of the present disclosure.
Figure 2:
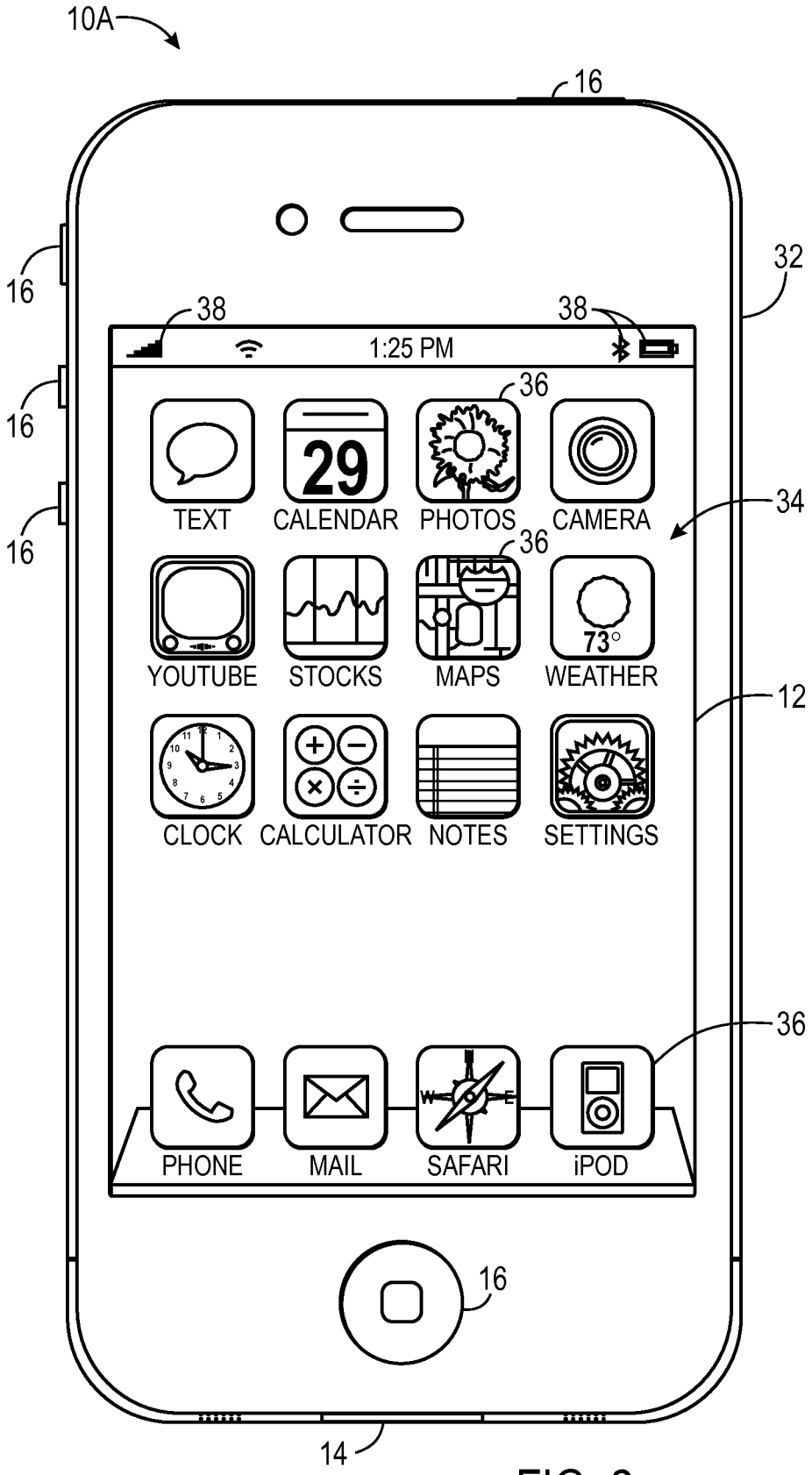
FIG. 2 illustrates a front view of a handheld device, such as an iPhone, representing another embodiment of the electronic device of FIG. 1, in accordance with an embodiment.
Figure 3:
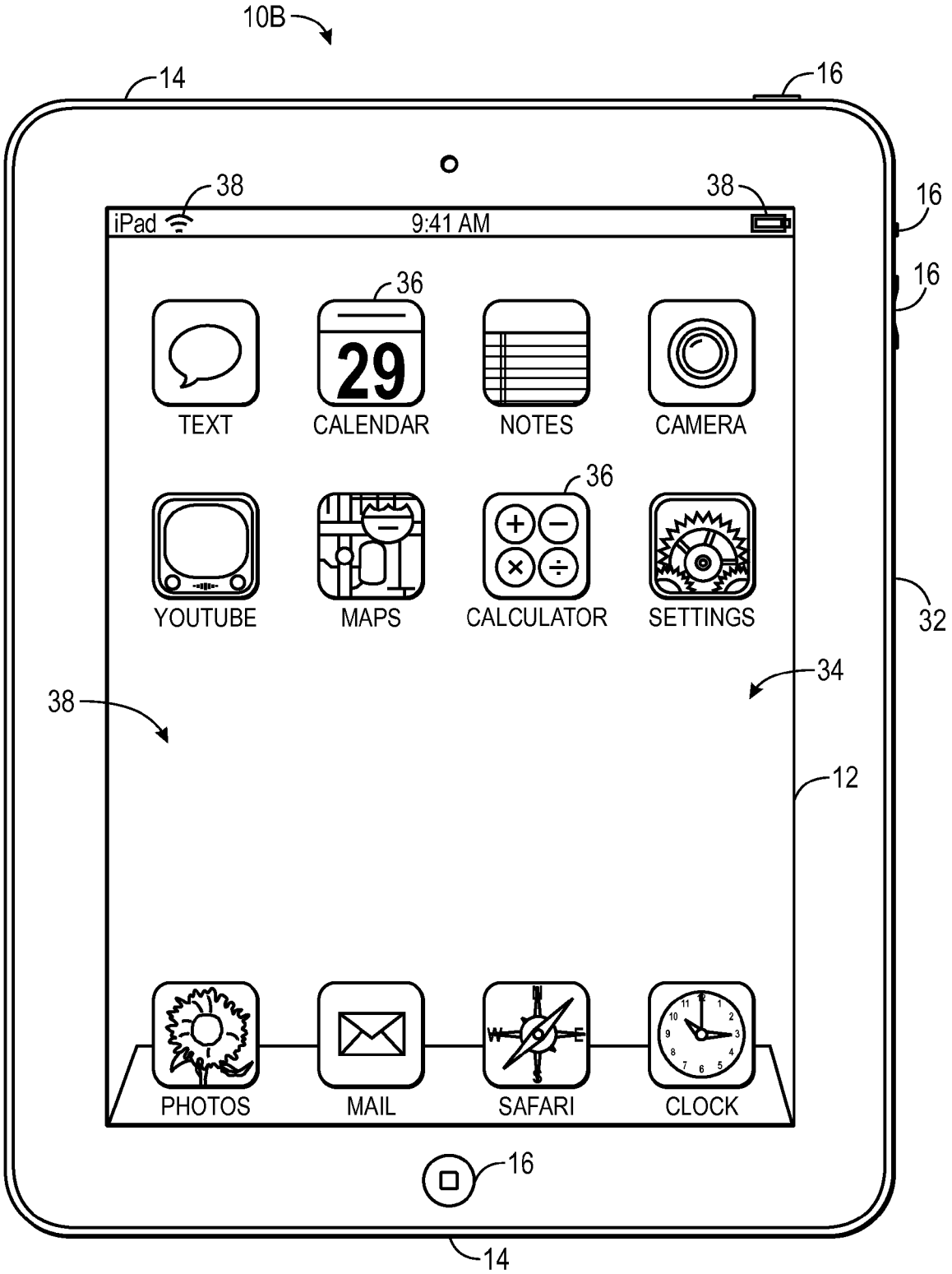
FIG. 3 illustrates a front view of a tablet device, such as an iPad, representing a further embodiment of the electronic device of FIG. 1, in accordance with an embodiment.
Figure 4:
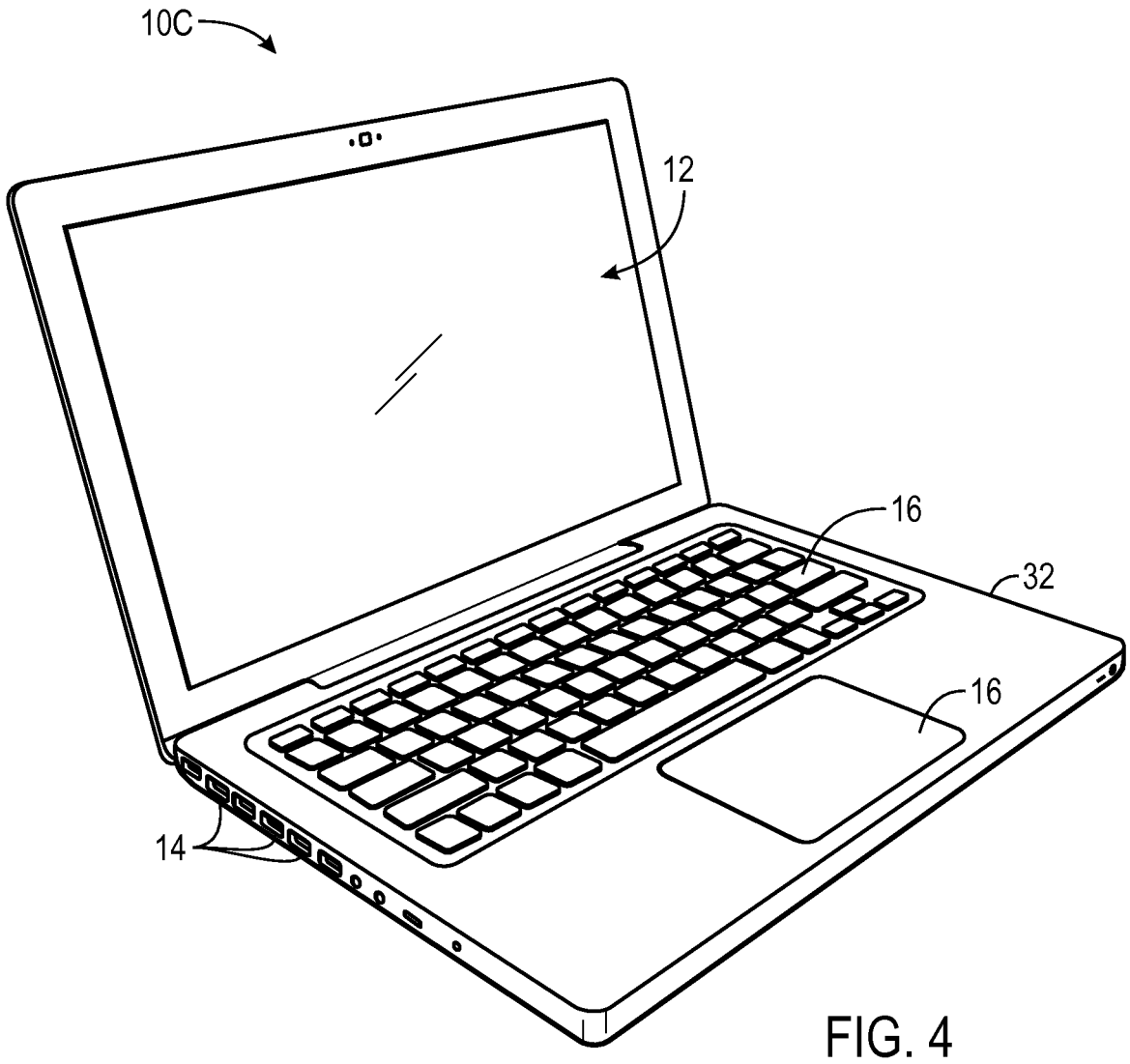
FIG. 4 illustrates a front view of a laptop computer, such as a MacBook, representing an embodiment of the electronic device of FIG. 1, in accordance with an embodiment.

With the foregoing in mind, it is useful to begin with a general description of suitable electronic devices that may employ the display devices and techniques described below. In particular, FIG. 1 is a block diagram depicting various components that may be present in an electronic device suitable for use with such display devices and techniques. FIGS. 2, 3, and 4 respectively illustrate front and perspective views of suitable electronic devices, which may be, as illustrated, a handheld electronic device, a tablet computing device, or a notebook computer.

Turning first to FIG. 1, an electronic device 10 according to an embodiment of the present disclosure may include, among other things, a display 12, input/output (I/O) ports 14, input structures 16, one or more processor(s) 18, memory 20, nonvolatile storage 22, an expansion card 24, RF circuitry 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in the electronic device 10.

By way of example, the electronic device 10 may represent a block diagram of the handheld device depicted in FIG. 2, the tablet computing device depicted in FIG. 3, the notebook computer depicted in FIG. 4, or similar devices, such as desktop computers, televisions, and so forth. It should be noted that the processor(s) 18 and/or other data processing circuitry may be generally referred to herein as "data processing circuitry." This data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 18 and/or other data processing circuitry may be operably coupled with the memory 20 and the nonvolatile storage 22 to execute instructions. Such programs or instructions executed by the processor(s) 18 may be stored in any suitable article of manufacture that includes one or more tangible, computer-readable media at least collectively storing the instructions or routines, such as the memory 20 and the nonvolatile storage 22. The memory 20 and the nonvolatile storage 22 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor(s) 18.

In one embodiment, the display 12 may be a touch-screen liquid crystal display (LCD), for example, which may enable users to interact with a user interface of the electronic device 10. In another embodiment, the display 12 may be an organic light emitting diode (OLED) display. In some embodiments, the electronic display 12 may be a MultiTouch™ display that can detect multiple touches at once.

The input structures 16 of the electronic device 10 may enable a user to interact with the electronic device 10 (e.g., pressing a button to increase or decrease a volume level). The I/O ports 14 may enable electronic device 10 to interface with various other electronic devices, as may the expansion card 24 and/or the RF circuitry 26. The expansion card 24 and/or the RF circuitry 26 may include, for example, interfaces for a personal area network (PAN), such as a Bluetooth network, for a local area network (LAN), such as an 802.11x Wi-Fi network, and/or for a wide area network (WAN), such as a 3G or 4G cellular network. The power source 28 of the electronic device 10 may be any suitable source of power, such as a rechargeable lithium polymer (Li-poly) battery and/or an alternating current (AC) power converter.

As mentioned above, the electronic device 10 may take the form of a computer or other type of electronic device. Such computers may include computers that are generally portable (such as laptop, notebook, and tablet computers) as well as computers that are generally used in one place (such as conventional desktop computers, workstations and/or servers). FIG. 2 depicts a front view of a handheld device 10A, which represents one embodiment of the electronic device 10. The handheld device 10A may represent, for example, a portable phone, a media player, a personal data organizer, a handheld game platform, or any combination of such devices. By way of example, the handheld device 10A may be a model of an iPod® or iPhone® available from Apple Inc. of Cupertino, Calif.

The handheld device 10A may include an enclosure 32 to protect interior components from physical damage and to shield them from electromagnetic interference. The enclosure 32 may surround the display 12, which may include a screen 34 for displaying icons 36. The screen 34 may also display indicator icons 38 to indicate, among other things, a cellular signal strength, Bluetooth connection, and/or battery life. The I/O ports 14 may open through the enclosure 32 and may include, for example, a proprietary I/O port from Apple Inc. to connect to external devices.

User input structures 16, in combination with the display 12, may allow a user to control the handheld device 10A. For example, the input structures 16 may activate or deactivate the handheld device 10A, navigate a user interface to a home screen, navigate a user interface to a user-configurable application screen, activate a voice-recognition feature of the handheld device 10A, provide volume control, and toggle between vibrate and ring modes. The electronic device 10 may also be a tablet device 10B, as illustrated in FIG. 3. For example, the tablet device 10B may be a model of an iPad® available from Apple Inc.

In certain embodiments, the electronic device 10 may take the form of a computer, such as a model of a MacBook®, MacBook® Pro, MacBook Air®, iMac®, Mac® mini, or Mac Pro® available from Apple Inc. By way of example, the electronic device 10, taking the form of a notebook computer 10C, is illustrated in FIG. 4 in accordance with one embodiment of the present disclosure. The depicted computer 10C may include a housing 32, a display 12, I/O ports 14, and input structures 16. In one embodiment, the input structures 16 (such as a keyboard and/or touchpad) may be used to interact with the computer 10C, such as to start, control, or operate a GUI or applications running on computer 10C. For example, a keyboard and/or touchpad may allow a user to navigate a user interface or application interface displayed on the display 12.

Figure 5:
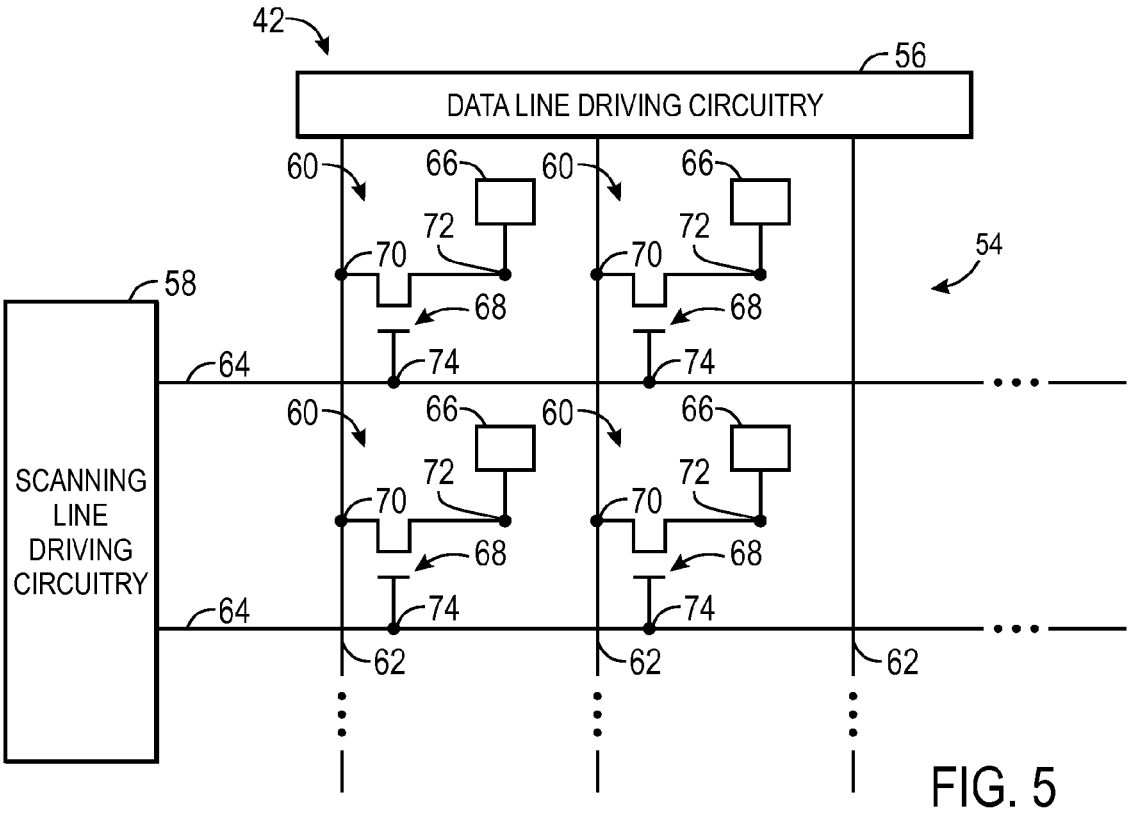
FIG. 5 illustrates circuitry that may be found in the display of FIG. 1, in accordance with an embodiment.

An electronic device 10, such as the devices 10A, 10B, and 10C discussed above, may be configured to reduce the power consumed by the display 12, such as by reducing power consumed by a demultiplexer of the display 12. FIG. 5 illustrates pixel-driving circuitry that may be found in the display 12 and may be configured for such operation. In certain embodiments, the pixel-driving circuitry depicted in FIG. 5 may be embodied on a liquid crystal display (LCD) panel 42 of the display 12. The pixel-driving circuitry includes an array or matrix 54 of unit pixels 60 that are driven by data (or source) line driving circuitry 56 and scanning (or gate) line driving circuitry 58. The matrix 54 of unit pixels 60 may form an image display region of the display 12. In such a matrix, each unit pixel 60 may be defined by the intersection of data lines 62 and scanning lines 64, which may also be referred to as source lines 62 and gate (or video scan) lines 64. The data line driving circuitry 56 may include one or more driver integrated circuits (also referred to as column drivers) for driving the data lines 62. The scanning line driving circuitry 58 may also include one or more driver integrated circuits (also referred to as row drivers).

Each unit pixel 60 includes a pixel electrode 66 and a thin film transistor (TFT) 68 for switching access to the pixel electrode 66. In the depicted embodiment, a source 70 of each TFT 68 is electrically connected to a data line 62 extending from respective data line driving circuitry 56, and a drain 72 is electrically connected to the pixel electrode 66. Similarly, in the depicted embodiment, a gate 74 of each TFT 68 is electrically connected to a scanning line 64 extending from respective scanning line driving circuitry 58.

In one embodiment, column drivers of the data line driving circuitry 56 send image signals to the pixels via the respective data lines 62. Such image signals may be applied by line-sequence, i.e., the data lines 62 may be sequentially activated during operation. The scanning lines 64 may apply scanning signals from the scanning line driving circuitry 58 to the gate 74 of each TFT 68. Such scanning signals may be applied by line-sequence with a predetermined timing or in a pulsed manner Each TFT 68 serves as a switching element which may be activated and deactivated (i.e., turned on and off) for a predetermined period based on the respective presence or absence of a scanning signal at its gate 74. When activated, a TFT 68 may store the image signals received via a respective data line 62 as a charge in the pixel electrode 66 with a predetermined timing.

The image signals stored at the pixel electrode 66 may be used to generate an electrical field between the respective pixel electrode 66 and a common electrode (VCOM) 76. Such an electrical field may align liquid crystals within a liquid crystal layer to modulate light transmission through the LCD panel 42. Unit pixels 60 may operate in conjunction with various color filters, such as red, green, and blue filters. In such embodiments, a "pixel" of the display may actually include multiple unit pixels, such as a red unit pixel, a green unit pixel, and a blue unit pixel, each of which may be modulated to increase or decrease the amount of light emitted to enable the display to render numerous colors via additive mixing of the colors.

In some embodiments, a storage capacitor may also be provided in parallel to the liquid crystal capacitor formed between the pixel electrode 66 and the common electrode to prevent leakage of the stored image signal at the pixel electrode 66. For example, such a storage capacitor may be provided between the drain 72 of the respective TFT 68 and a separate capacitor line.

Figure 6:
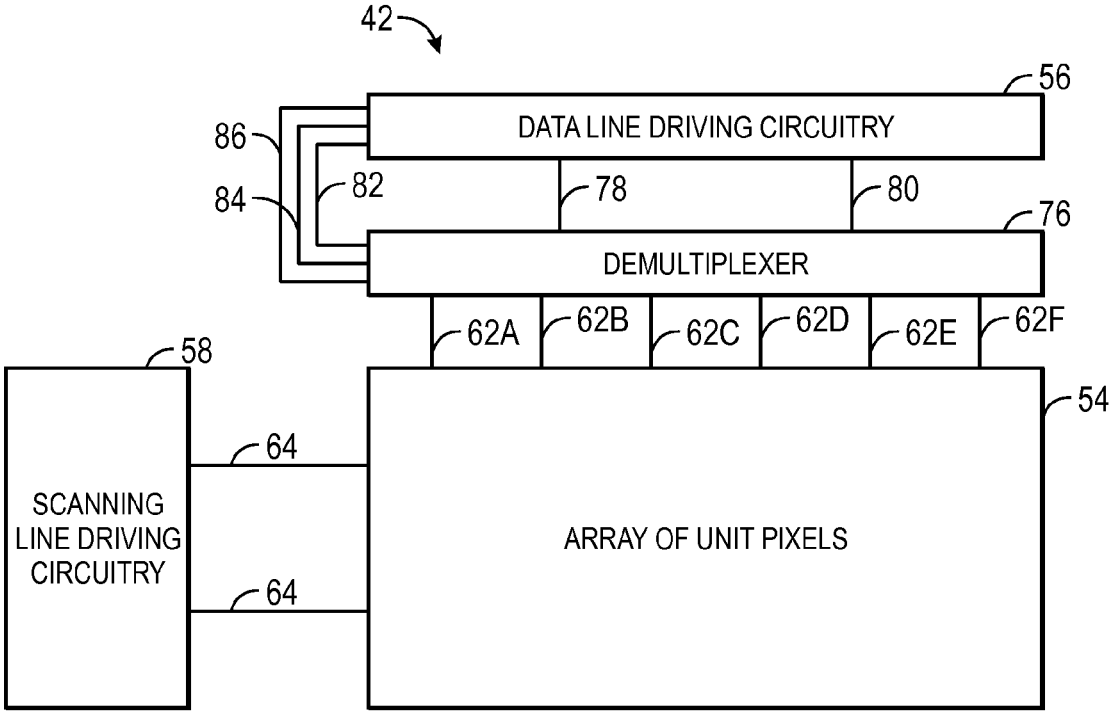
FIG. 6 illustrates circuitry including a demultiplexer that may be found in the display of FIG. 1, in accordance with an embodiment.

Additional components that may be used to provide image signals to the LCD panel 42 are depicted in FIG. 6. In the illustrated embodiment, a demultiplexer 76 is electrically coupled between the data line driving circuitry 56 and the array of unit pixels 54. The demultiplexer 76 enables the data line driving circuitry 56 to include fewer outputs than the total number of data lines 62. For example, the demultiplexer 76 may enable a ratio of data line driving circuitry 56 outputs to data lines 62 of 1 to 2, 1 to 3, 1 to 4, and so forth. Specifically, in the illustrated embodiment, the ratio of data line driving circuitry 56 outputs to data lines 62 is 1 to 3. Accordingly, the demultiplexer 76 receives data from a data line driver A 78 output from the data line driving circuitry 56 and demultiplexes the data onto data lines 62A, 62B, and 62C. Furthermore, the demultiplexer 76 receives data from a data line driver B 80 output from the data line driving circuitry 56 and demultiplexes the data onto data lines 62D, 62E, and 62F. As may be appreciated, the demultiplexer 76 may be controlled by various control signals to facilitate demultiplexing. In certain embodiments, the control signals may be used to activate and deactivate gates of TFTs used to provide data from the data line drivers A 78 and B 80 to the data lines 62. For example, an activation line A 82, an activation line B 84, and an activation line C 86 may be controlled by the data line driving circuitry 56 to activate and deactivate gates of TFTs of the demultiplexer 76. While the demultiplexer 76 is illustrated as being separate from the data line driving circuitry 56, in certain embodiments, the demultiplexer 76 may be part of the data line driving circuitry 56. Furthermore, while the demultiplexer 76 is illustrated as being part of an LCD panel 42, in other embodiments, the demultiplexer 76 may be part of an OLED display, or any other suitable electronic device.

Figure 7:
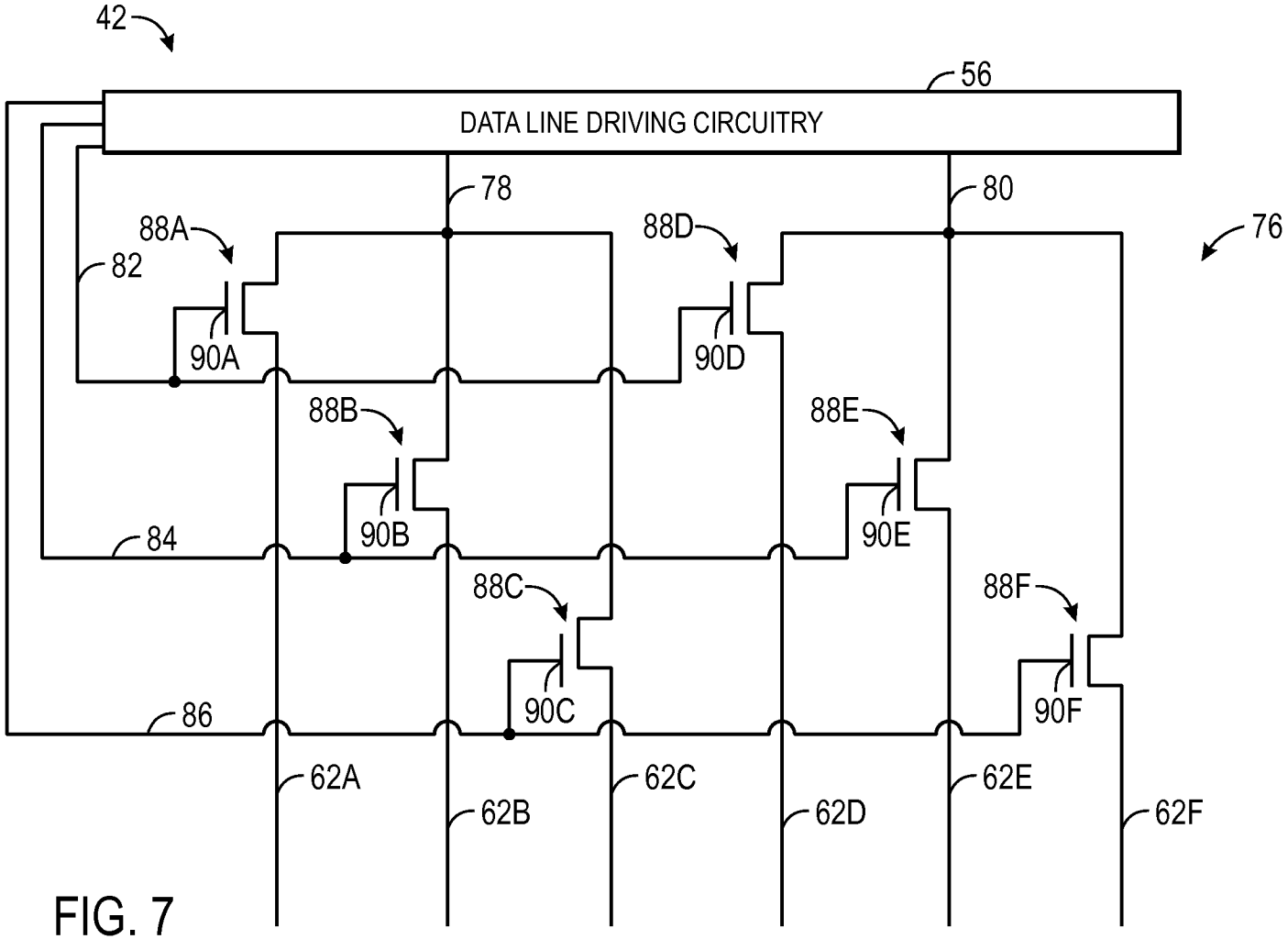
FIG. 7 illustrates demultiplexer circuitry that may be found in the display of FIG. 1, in accordance with an embodiment.

Circuitry of the demultiplexer 76 may be arranged in a variety of ways. FIG. 7 illustrates one embodiment of circuitry of the demultiplexer 76. As illustrated, the demultiplexer 76 includes TFTs 88 that are used to switch provide from the data line drivers A 78 and B 80 to the data lines 62. The TFTs 88 may be any suitable TFTs, such as n-type TFTs, p-type TFTs, CMOS TFTs, and so forth. Moreover, in certain embodiments, the demultiplexer 76 may include any suitable switching device in place of the TFTs 88.

As may be appreciated, the output of the demultiplexer 76 may be determined based on which gates 90 of the TFTs 88 are activated. Specifically, during operation of the LCD panel 42, the data line driving circuitry 56 may drive the activation line A 82 to activate gate 90A of TFT 88A and to activate gate 90D of TFT 88D. With the gate 90A activated, data may be provided from the data line driver A 78 to the data line 62A. Moreover, with the gate 90D activated, data may be provided from the data line driver B 80 to the data line 62D.

Furthermore, the data line driving circuitry 56 may drive the activation line B 84 to activate gate 90B of TFT 88B and to activate gate 90E of TFT 88E. With the gate 90B activated, data may be provided from the data line driver A 78 to the data line 62B. Moreover, with the gate 90E activated, data may be provided from the data line driver B 80 to the data line 62E.

Similarly, the data line driving circuitry 56 may drive the activation line C 86 to activate gate 90C of TFT 88C and to activate gate 90F of TFT 88F. With the gate 90C activated, data may be provided from the data line driver A 78 to the data line 62C. Moreover, with the gate 90F activated, data may be provided from the data line driver B 80 to the data line 62F. As may be appreciated, during operation only one of the gates 90A, 90B, and 90C may be activated at a time to properly demultiplex the data from the data line driver A 78 to the data lines 62A, 62B, and 62C. Furthermore, only one of the gates 90D, 90E, and 90F may be activated at a time to properly demultiplex the data from the data line driver B 80 to the data lines 62D, 62E, and 62F.

Total power consumption of the demultiplexer 76 may be calculated using the following formula: P=N*C*V^2*F. In this equation, P corresponds to a total power consumption of the demultiplexer 76, N corresponds to a number of demultiplexer 76 control lines (e.g., activation lines), C corresponds to the total capacitance of one demultiplexer 76 control line, V corresponds to a voltage swing of the voltage provided on the control lines (e.g., 15 to 20 volts), and F corresponds to a frequency calculated by a frame rate multiplied by a number of vertical lines.

Figure 8:
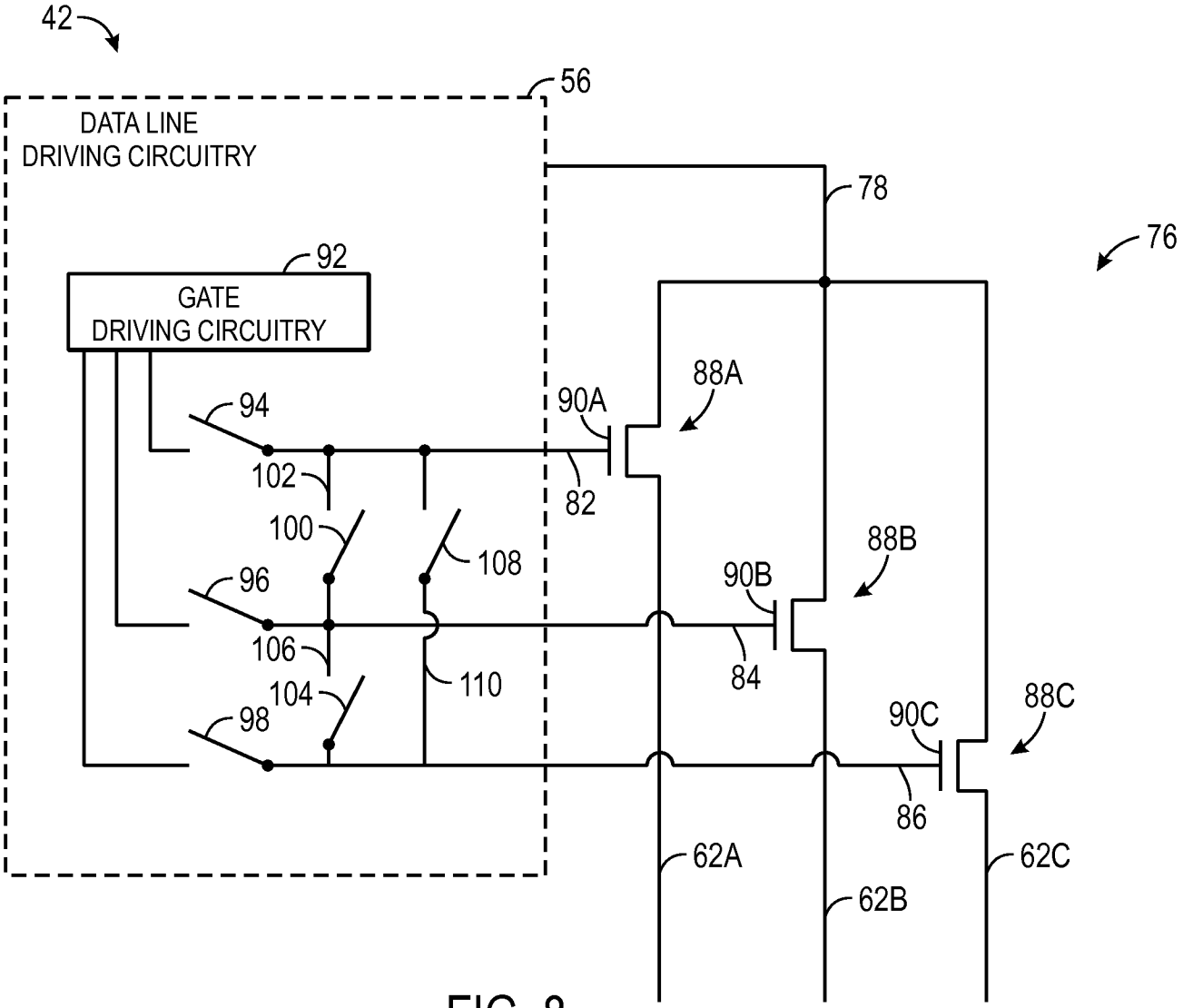
FIG. 8 illustrates driving circuitry that may be found in the display of FIG. 1, in accordance with an embodiment.

As may be appreciated, power may be consumed by charging a capacitance of the gates 90 while the gates 90 are being activated. Accordingly, by decreasing the amount of power needed to charge the capacitance of the gates 90, the total power consumption of the demultiplexer 76 may be reduced. For example, in certain embodiments, the power consumption of the demultiplexer 76 may be reduced by approximately 50%. In such an embodiment, the power consumption of the demultiplexer 76 may be determined by using the following formula: P=N*C*V^2*F/2. Moreover, FIG. 8 illustrates an embodiment of an LCD panel 42 that includes circuitry to facilitate reduced power consumption of the demultiplexer 76.

As illustrated, the data line driving circuitry 56 includes gate driving circuitry 92 for activating the gates 90 of the TFTs 88. The activation line A 82 is electrically coupled between the gate driving circuitry 92 and the gate 90A to carry signals for driving the gate 90A. Moreover, a switch A 94 is electrically coupled between the gate driving circuitry 92 and the gate 90A. The switch A 94 is controlled to a closed position and to an open position by the data line driving circuitry 56 to electrically connect (e.g., make) and disconnect (e.g., break) the gate driving circuitry 92 and the gate 90A, respectively.

Furthermore, the activation line B 84 is electrically coupled between the gate driving circuitry 92 and the gate 90B to carry signals for driving the gate 90B. Moreover, a switch B 96 is electrically coupled between the gate driving circuitry 92 and the gate 90B. The switch B 96 is controlled to a closed position and to an open position by the data line driving circuitry 56 to electrically connect and disconnect the gate driving circuitry 92 and the gate 90B, respectively.

In addition, the activation line C 86 is electrically coupled between the gate driving circuitry 92 and the gate 90C to carry signals for driving the gate 90C. Moreover, a switch C 98 is electrically coupled between the gate driving circuitry 92 and the gate 90C. The switch C 98 is controlled to a closed position and to an open position by the data line driving circuitry 56 to electrically connect and disconnect the gate driving circuitry 92 and the gate 90C, respectively.

The data line driving circuitry 56 also includes a switch AB 100 electrically coupled between the gate 90A and the gate 90B. The switch AB 100 is controlled by the data line driving circuitry 56 to a closed position to establish a connection 102 (e.g., make the connection 102, connect) between the gate 90A and the gate 90B. Moreover, the switch AB 100 is controlled by the data line driving circuitry 56 to an open position to disconnect (e.g., break the connection 102) the gate 90A from the gate 90B.

Furthermore, the data line driving circuitry 56 also includes a switch BC 104 electrically coupled between the gate 90B and the gate 90C. The switch BC 104 is controlled by the data line driving circuitry 56 to a closed position to establish a connection 106 (e.g., make the connection 106, connect) between the gate 90B and the gate 90C. Moreover, the switch BC 104 is controlled by the data line driving circuitry 56 to an open position to disconnect (e.g., break the connection 106) the gate 90B from the gate 90C.

In addition, the data line driving circuitry 56 also includes a switch AC 108 electrically coupled between the gate 90A and the gate 90C. The switch AC 108 is controlled by the data line driving circuitry 56 to a closed position to establish a connection 110 (e.g., make the connection 110, connect) between the gate 90A and the gate 90C. Moreover, the switch AC 108 is controlled by the data line driving circuitry 56 to an open position to disconnect (e.g., break the connection 110) the gate 90A from the gate 90C. The switches 94, 96, 98, 100, 104, and 108 may be any suitable switching device (e.g., transistor). As may be appreciated, although the switches 94, 96, 98, 100, 104, and 108 are described as being part of the data line driving circuitry 56, the switches may not be part of the data line driving circuitry 56. Moreover, the switches 94, 96, 98, 100, 104, and 108 may be controlled by any suitable control circuitry.

Figure 9:
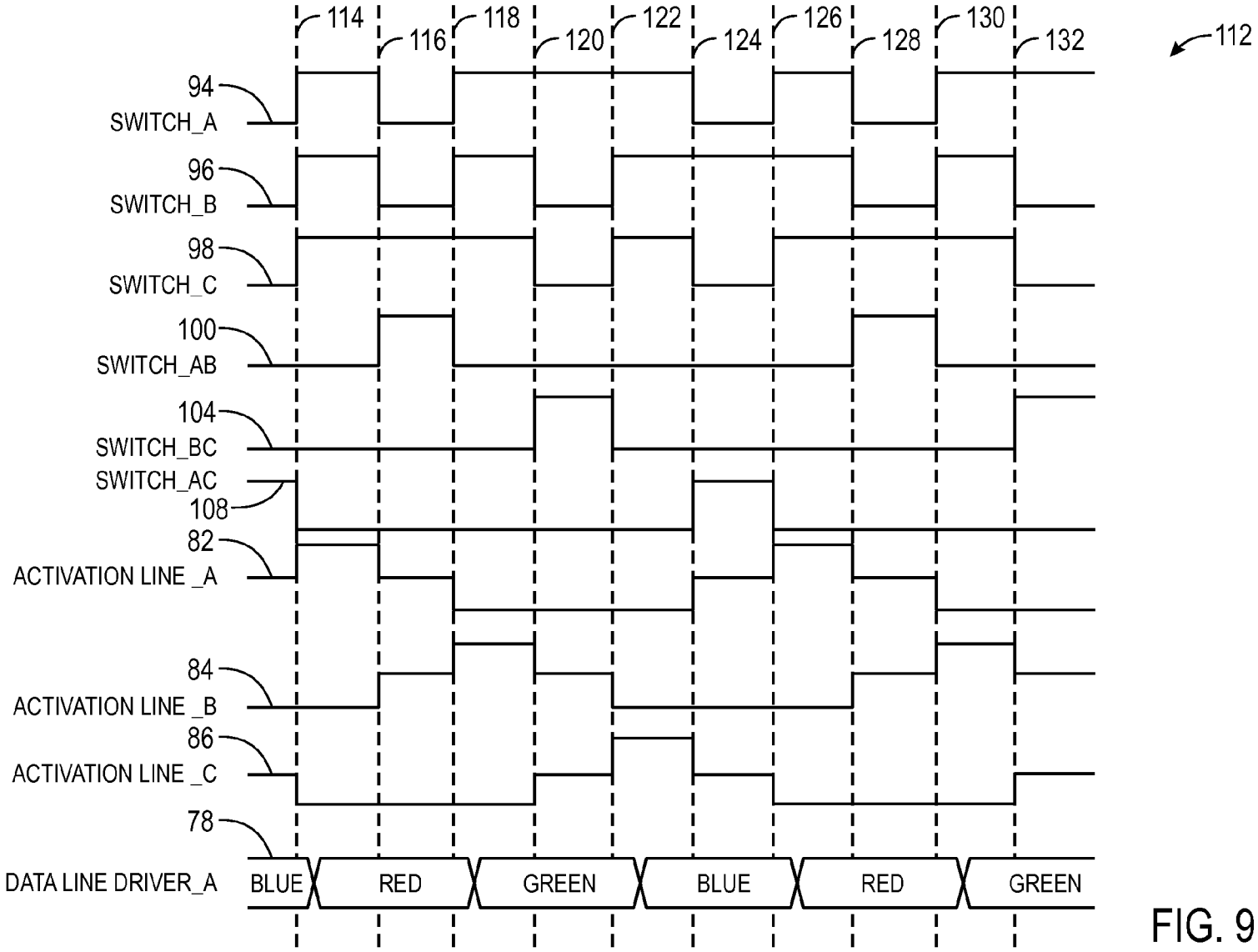
FIG. 9 illustrates a timing diagram of signals that may be used to drive a demultiplexer of the display of FIG. 1, in accordance with an embodiment.

The switches AB 100, BC 104, and AC 108 may be used to share a charge stored on one of the gates 90 with another gate. Accordingly, FIG. 9 illustrates a timing diagram 112 that shows one embodiment for operating the data line driving circuitry 56 in conjunction with the demultiplexer 76. Specifically, at a time 114, the switch A 94, the switch B 96, and the switch C 98 all transition from an open position to a closed position where they remain until a time 116. Furthermore, between times 114 and 116, the switches AB 100, BC 104, and AC 108 are all open. Moreover, the activation line A 82 is driven to a logic high voltage to activate the gate 90A. In addition, the activation lines B 84 and C 86 are driven to a logic low voltage so that the gates 90B and 90C are not activated. With the gate 90A active, data provided by the data line driver A 78 is provided to the data line 62A. For example, data for a red pixel may be provided between the time 114 and the time 116.

At the time 116, the switch A 94 and the switch B 96 transition from the closed position to the open position where they remain until a time 118. Furthermore, between times 116 and 118, the switches BC 104 and AC 108 are open, while the switch AB 100 is closed. With the switch AB 100 closed, the gate 90A is electrically coupled to the gate 90B. Moreover, the charge stored by the gate 90A is shared with the gate 90B, such that gate 90A and the gate 90B may have approximately the same charge. For example, each of gates 90A and 90B may be charged with approximately half of the charge needed to drive the gates 90A and 90B (e.g., the charge of the gate 90A is shared with the gate 90B). Accordingly, the activation lines A 82 and B 84 may be driven to a voltage between a logic low voltage and a logic high voltage (e.g., midway point) where the gates 90A and 90B are not activated. The activation line C 86 is driven to a logic low voltage so that the gate 90C is not activated. Because none of the gates 90A, 90B, and 90C are activated, data provided by the data line driver A 78 is not provided to one of the data lines 62.

At the time 118, the switch A 94 and the switch B 96 transition from the open position to the closed position where they remain until a time 120. Furthermore, between times 118 and 120, the switches AB 100, BC 104, and AC 108 are all open. Moreover, the activation line B 84 is driven to a logic high voltage to activate the gate 90B. Because of the charge sharing from the gate 90A, the voltage applied to the activation line B 84 changes from the midway point to the logic high voltage rather than changing from the logic low voltage to the logic high voltage. Therefore, the voltage swing used to drive the gate 90B is reduced. In certain embodiments, the voltage swing to drive the gate 90B may be reduced by approximately 50% (e.g., reduced in half). Moreover, in some embodiments, the charge sharing between the gates 90A and 90B may reduce power for driving the activation line B 84 by approximately 50%. In other embodiments, the charge sharing between the gates 90A and 90B may reduce power for driving the activation line B 84 by a factor of four. Accordingly, the power consumption of the demultiplexer 76 may be reduced, thereby reducing power consumption of the display 12. The activation lines A 82 and C 86 are driven to a logic low voltage so that the gates 90A and 90C are not activated. With the gate 90B active, data provided by the data line driver A 78 is provided to the data line 62B. For example, data for a green pixel may be provided between the time 118 and the time 120.

At the time 120, the switch B 96 and the switch C 98 transition from the closed position to the open position where they remain until a time 122. Furthermore, between times 120 and 122, the switches AB 100 and AC 108 are open, while the switch BC 104 is closed. With the switch BC 104 closed, the gate 90B is electrically coupled to the gate 90C. Moreover, the charge stored by the gate 90B is shared with the gate 90C, such that gate 90B and the gate 90C may have approximately the same charge. For example, each of gates 90B and 90C may be charged with approximately half of the charge needed to drive the gates 90B and 90C (e.g., the charge of the gate 90B is shared with the gate 90C). Accordingly, the activation lines B 84 and C 86 may be driven to a voltage between a logic low voltage and a logic high voltage (e.g., midway point) where the gates 90B and 90C are not activated. The activation line A 82 is driven to a logic low voltage so that the gate 90A is not activated. Because none of the gates 90A, 90B, and 90C are activated, data provided by the data line driver A 78 is not provided to one of the data lines 62.

At the time 122, the switch B 96 and the switch C 98 transition from the open position to the closed position where they remain until a time 124. Furthermore, between times 122 and 124, the switches AB 100, BC 104, and AC 108 are all open. Moreover, the activation line C 86 is driven to a logic high voltage to activate the gate 90C. Because of the charge sharing from the gate 90B, the voltage applied to the activation line C 86 changes from the midway point to the logic high voltage rather than changing from the logic low voltage to the logic high voltage. Therefore, the voltage swing used to drive the gate 90C is reduced. In certain embodiments, the voltage swing to drive the gate 90C may be reduced by approximately 50% (e.g., reduced in half). Moreover, in some embodiments, the charge sharing between the gates 90B and 90C may reduce power for driving the activation line C 86 by approximately 50%. In other embodiments, the charge sharing between the gates 90B and 90C may reduce power for driving the activation line C 86 by a factor of four. Accordingly, the power consumption of the demultiplexer 76 may be reduced, thereby reducing power consumption of the display 12. The activation lines A 82 and B 84 are driven to a logic low voltage so that the gates 90A and 90B are not activated. With the gate 90C active, data provided by the data line driver A 78 is provided to the data line 62C. For example, data for a blue pixel may be provided between the time 122 and the time 124.

At the time 124, the switch A 94 and the switch C 98 transition from the closed position to the open position where they remain until a time 126. Furthermore, between times 124 and 126, the switches AB 100 and BC 104 are open, while the switch AC 108 is closed. With the switch AC 108 closed, the gate 90C is electrically coupled to the gate 90A. Moreover, the charge stored by the gate 90C is shared with the gate 90A, such that gate 90C and the gate 90A may have approximately the same charge. For example, each of gates 90C and 90A may be charged with approximately half of the charge needed to drive the gates 90C and 90A (e.g., the charge of the gate 90C is shared with the gate 90A). Accordingly, the activation lines C 86 and A 82 may be driven to a voltage between a logic low voltage and a logic high voltage (e.g., midway point) where the gates 90C and 90A are not activated. The activation line B 84 is driven to a logic low voltage so that the gate 90B is not activated. Because none of the gates 90A, 90B, and 90C are activated, data provided by the data line driver A 78 is not provided to one of the data lines 62.

The pattern described between times 114 and 126 then repeats throughout operation, such that signals between times 126 and 128 are similar to the signals between times 114 and 116, signals between times 128 and 130 are similar to the signals between times 116 and 118, signals between times 130 and 132 are similar to the signals between times 118 and 120, and so forth. As illustrated, the switch A 94 may remain closed while the switch BC 104 is closed, the switch B 96 may remain closed while the switch AC 108 is closed, and the switch C 98 may remain closed while the switch AB 100 is closed. However, in other embodiments, the switch A 94 may be open while the switch BC 104 is closed, the switch B 96 may be open while the switch AC 108 is closed, and the switch C 98 may be open while the switch AB 100 is closed.

Figure 10:
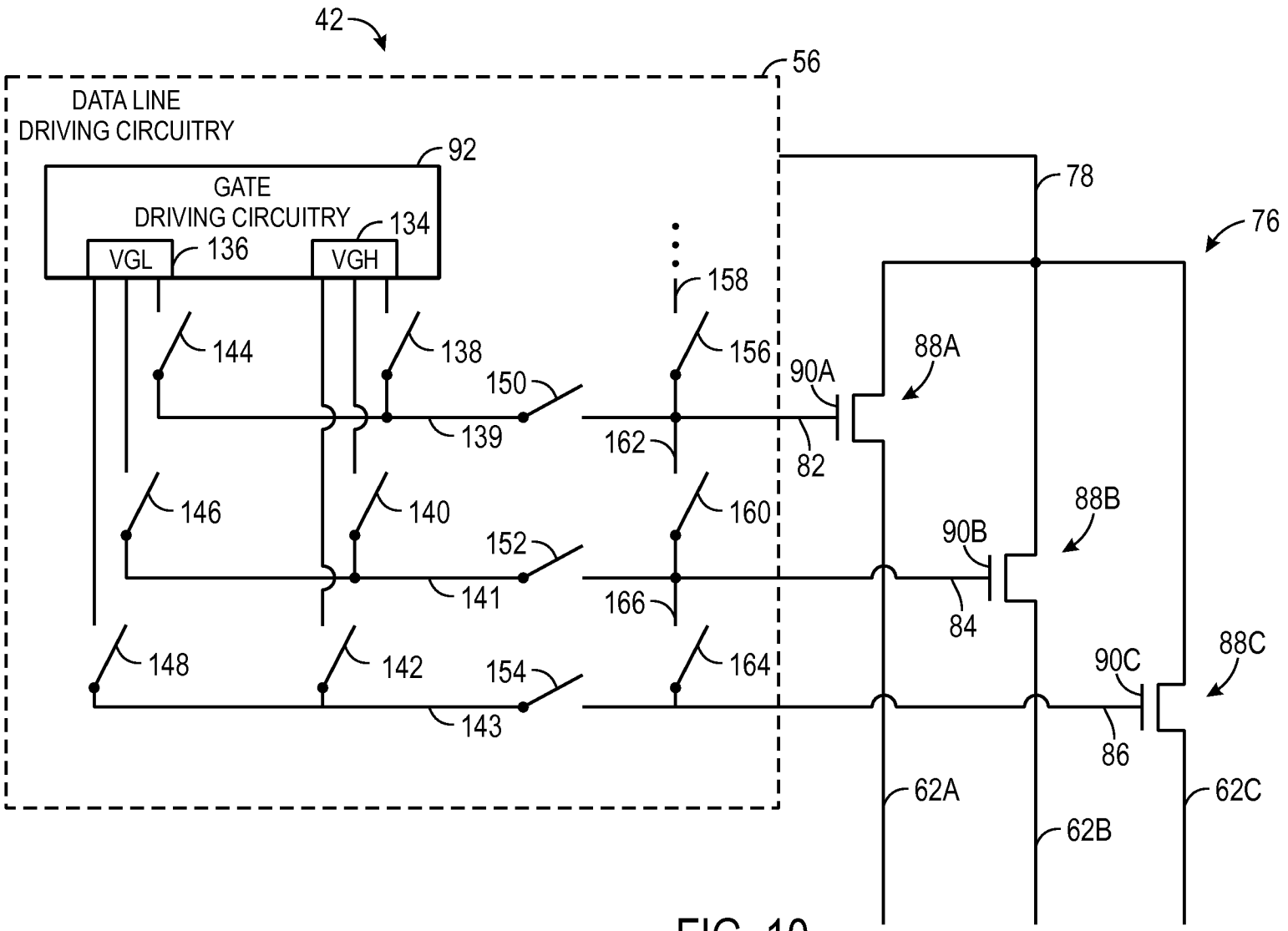
FIG. 10 illustrates driving circuitry that may be found in the display of FIG. 1, in accordance with an embodiment.

As may be appreciated, circuitry of the LCD panel 42 may be configured in a variety of ways to reduce power consumption of the demultiplexer 76. For example, FIG. 10 illustrates another embodiment of an LCD panel 42 that includes circuitry to facilitate reduced power consumption of the demultiplexer 76.

As illustrated, the data line driving circuitry 56 includes the gate driving circuitry 92 for activating the gates 90 of the TFTs 88. The gate driving circuitry 92 includes a high gate output voltage (VGH) 134 which may be used to activate the gates 90. For example, in certain embodiments, the voltage of VGH 134 may be somewhere between approximately 5 to 20 volts, 5 to 10 volts, or 10 to 25 volts. The gate driving circuitry 92 also includes a low gate output voltage (VGL) 136 which may be used to deactivate the gates 90. For example, in certain embodiments, the voltage of VGL 136 may be approximately 0 volts.

The activation line A 82 is electrically coupled between the VGH 134 of the gate driving circuitry 92 and the gate 90A to carry signals for activating the gate 90A. Moreover, a switch SWH_A 138 is electrically coupled between the VGH 134 and a segment A 139 of the activation line A 82. The switch SWH_A 138 is controlled to a closed position and to an open position by the data line driving circuitry 56 to electrically connect (e.g., make) and disconnect (e.g., break) the VGH 134 and the segment A 139, respectively.

Furthermore, the activation line B 84 is electrically coupled between the VGH 134 of the gate driving circuitry 92 and the gate 90B to carry signals for activating the gate 90B. Moreover, a switch SWH_B 140 is electrically coupled between the VGH 134 and a segment B 141 of the activation line B 84. The switch SWH_B 140 is controlled to a closed position and to an open position by the data line driving circuitry 56 to electrically connect (e.g., make) and disconnect (e.g., break) the VGH 134 and the segment B 141, respectively.

In addition, the activation line C 86 is electrically coupled between the VGH 134 of the gate driving circuitry 92 and the gate 90C to carry signals for activating the gate 90C. Moreover, a switch SWH_C 142 is electrically coupled between the VGH 134 and a segment C 143 of the activation line C 86. The switch SWH_C 142 is controlled to a closed position and to an open position by the data line driving circuitry 56 to electrically connect (e.g., make) and disconnect (e.g., break) the VGH 134 and the segment C 143, respectively.

A switch SWL_A 144 is electrically coupled between the VGL 136 and the segment A 139. The switch SWL_A 144 is controlled to a closed position and to an open position by the data line driving circuitry 56 to electrically connect (e.g., make) and disconnect (e.g., break) the VGL 136 and the segment A 139, respectively. Furthermore, a switch SWL_B 146 is electrically coupled between the VGL 136 and the segment B 141. The switch SWL_B 146 is controlled to a closed position and to an open position by the data line driving circuitry 56 to electrically connect (e.g., make) and disconnect (e.g., break) the VGL 136 and the segment B 141, respectively. In addition, a switch SWL_C 148 is electrically coupled between the VGL 136 and the segment C 143. The switch SWL_C 148 is controlled to a closed position and to an open position by the data line driving circuitry 56 to electrically connect (e.g., make) and disconnect (e.g., break) the VGL 136 and the segment C 143, respectively.

Moreover, a switch SWG_A 150 is electrically coupled between the segment A 139 and the gate 90A. The switch SWG_A 150 is controlled to a closed position and to an open position by the data line driving circuitry 56 to electrically connect (e.g., make) and disconnect (e.g., break) the segment A 139 and the gate 90A, respectively. Furthermore, a switch SWG_B 152 is electrically coupled between the segment B 141 and the gate 90B. The switch SWG_B 152 is controlled to a closed position and to an open position by the data line driving circuitry 56 to electrically connect (e.g., make) and disconnect (e.g., break) the segment B 141 and the gate 90B, respectively. In addition, a switch SWG_C 154 is electrically coupled between the segment C 143 and the gate 90C. The switch SWG_C 154 is controlled to a closed position and to an open position by the data line driving circuitry 56 to electrically connect (e.g., make) and disconnect (e.g., break) the segment C 143 and the gate 90C, respectively.

The data line driving circuitry 56 also includes a switch SWI_A 156 configured to be electrically coupled between the gate 90A and another gate. The switch SWI_A 156 is controlled by the data line driving circuitry 56 to a closed position to establish a connection 158 (e.g., make the connection 158, connect) between the gate 90A and another gate. Moreover, the switch SWI_A 156 is controlled by the data line driving circuitry 56 to an open position to disconnect (e.g., break the connection 158) the gate 90A from another gate.

Furthermore, the data line driving circuitry 56 also includes a switch SWI_B 160 electrically coupled between the gate 90B and the gate 90C. The switch SWI_B 160 is controlled by the data line driving circuitry 56 to a closed position to establish a connection 162 (e.g., make the connection 162, connect) between the gate 90A and the gate 90B. Moreover, the switch SWI_B 160 is controlled by the data line driving circuitry 56 to an open position to disconnect (e.g., break the connection 162) the gate 90A from the gate 90B.

In addition, the data line driving circuitry 56 also includes a switch SWIC 164 electrically coupled between the gate 90B and the gate 90C. The switch SWI_C 164 is controlled by the data line driving circuitry 56 to a closed position to establish a connection 166 (e.g., make the connection 166, connect) between the gate 90B and the gate 90C. Moreover, the switch SWI_C 164 is controlled by the data line driving circuitry 56 to an open position to disconnect (e.g., break the connection 166) the gate 90B from the gate 90C. The switches 138, 140, 142, 144, 146, 148, 150, 152, 154, 156, 160, and 164 may be any suitable switching device (e.g., transistor). As may be appreciated, although the switches 138, 140, 142, 144, 146, 148, 150, 152, 154, 156, 160, and 164 are described as being part of the data line driving circuitry 56, the switches may not be part of the data line driving circuitry 56. Moreover, the switches 138, 140, 142, 144, 146, 148, 150, 152, 154, 156, 160, and 164 may be controlled by any suitable control circuitry. In certain embodiments, fewer or more switches may be used.

Figure 11:
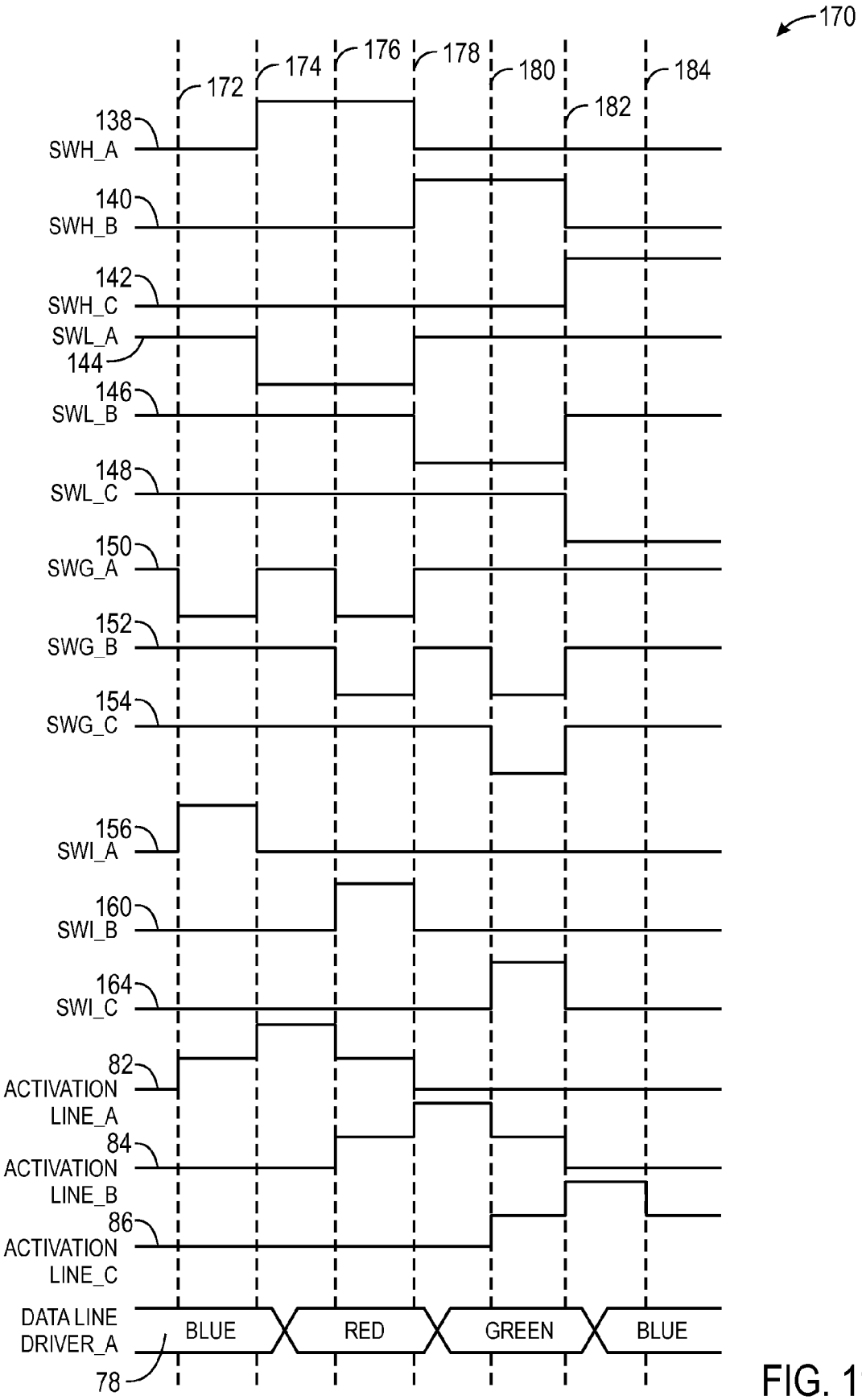
FIG. 11 illustrates a timing diagram of signals that may be used to drive a demultiplexer of the display of FIG. 1, in accordance with an embodiment.

The switches SWI_A 156, SWI_B 160, and SWI_C 164 may be used to share a charge stored on one of the gates 90 with another gate. Accordingly, FIG. 11 illustrates a timing diagram 170 that shows one embodiment for operating the data line driving circuitry 56 in conjunction with the demultiplexer 76. Specifically, at a time 172, the switch SWG_A 150 transitions from a closed position to an open position where it remains until a time 174. The switch SWI_A 156 transitions from an open position to a closed position where it remains until the time 174. Furthermore, between times 172 and 174, the switches SWH_A 138, SWH_B 140, SWH_C 142, SWI_B 160, and SWI_C 164 are all open, while the switches SWL_A 144, SWL_B 146, SWL_C 148, SWG_B 160, and SWG_C 164 are all closed. Moreover, the activation line A 82 shares a voltage with another activation line connected to the activation line A 82 by the switch SWI_A 156. In addition, the activation lines B 84 and C 86 are driven to a logic low voltage so that the gates 90B and 90C are not activated.

At the time 174, the switches SWH_A 138 and SWG_A 150 transition from an open position to a closed position where they remain until a time 176. The switches SWL_A 144 and SWI_A 156 transition from a closed position to an open position where they remain until the time 176. Furthermore, between times 174 and 176, the switches SWH_B 140, SWH_C 142, SWI_B 160, and SWI_C 164 are all open, while the switches SWL_B 146, SWL_C 148, SWG_B 160, and SWG_C 164 are all closed. Moreover, the activation line A 82 is driven to a logic high voltage to activate the gate 90A. In addition, the activation lines B 84 and C 86 are driven to a logic low voltage so that the gates 90B and 90C are not activated. With the gate 90A active, data provided by the data line driver A 78 is provided to the data line 62A. For example, data for a red pixel may be provided between the time 174 and the time 176.

At the time 176, the switches SWG_A 150 and SWG_B 152 transition from a closed position to an open position where they remain until a time 178. The switch SWI_B 160 transitions from an open position to a closed position where it remains until the time 178. Furthermore, between times 176 and 178, the switches SWH_B 140, SWH_C 142, SWL_A 144, SWI_A 156, and SWI_C 164 are all open, while the switches SWH_A 138, SWL_B 146, SWL_C 148, and SWG_C 164 are all closed. With the switch SWI_B 160 closed, the gate 90A is electrically coupled to the gate 90B. Moreover, the charge stored by the gate 90A is shared with the gate 90B, such that gate 90A and the gate 90B may have approximately the same charge. For example, each of gates 90A and 90B may be charged with approximately half of the charge needed to drive the gates 90A and 90B (e.g., the charge of the gate 90A is shared with the gate 90B). Accordingly, the activation lines A 82 and B 84 may be driven to a voltage between a logic low voltage and a logic high voltage (e.g., midway point) where the gates 90A and 90B are not activated. The activation line C 86 is driven to a logic low voltage so that the gate 90C is not activated. Because none of the gates 90A, 90B, and 90C are activated, data provided by the data line driver A 78 is not provided to one of the data lines 62.

At the time 178, the switches SWH_B 140, SWL_A 144, SWG_A 150, and SWG_B 152 transition from an open position to a closed position where they remain until a time 180. The switches SWH_A 138, SWL_B 146, and SWI_B 160 transition from a closed position to an open position where they remain until the time 180. Furthermore, between times 178 and 180, the switches SWH_C 142, SWI_A 156, and SWI_C 164 are all open, while the switches SWL_C 148 and SWG_C 164 are all closed. Moreover, the activation line B 84 is driven to a logic high voltage to activate the gate 90B. Because of the charge sharing from the gate 90A, the voltage applied to the activation line B 84 changes from the midway point to the logic high voltage rather than changing from the logic low voltage to the logic high voltage. Therefore, the voltage swing used to drive the gate 90B is reduced. In certain embodiments, the voltage swing to drive the gate 90B may be reduced by approximately 50% (e.g., reduced in half).

Moreover, in some embodiments, the charge sharing between the gates 90A and 90B may reduce power for driving the activation line B 84 by approximately 50%. In other embodiments, the charge sharing between the gates 90A and 90B may reduce power for driving the activation line B 84 by a factor of four. Accordingly, the power consumption of the demultiplexer 76 may be reduced, thereby reducing power consumption of the display 12. The activation lines A 82 and C 86 are driven to a logic low voltage so that the gates 90A and 90C are not activated. With the gate 90B active, data provided by the data line driver A 78 is provided to the data line 62B. For example, data for a green pixel may be provided between the time 178 and the time 180.

At the time 180, the switches SWG_B 152 and SWG_C 154 transition from a closed position to an open position where they remain until a time 182. The switch SWI_C 164 transitions from an open position to a closed position where it remains until the time 182. Furthermore, between times 180 and 182, the switches SWH_A 138, SWH_C 142, SWL_B 146, SWI_A 156, and SWI_B 160 are all open, while the switches SWH_B 140, SWL_A 144, SWL_C 148, and SWG_A 150 are all closed. With the switch SWI_C 164 closed, the gate 90B is electrically coupled to the gate 90C. Moreover, the charge stored by the gate 90B is shared with the gate 90C, such that gate 90B and the gate 90C may have approximately the same charge. For example, each of gates 90B and 90C may be charged with approximately half of the charge needed to drive the gates 90B and 90C (e.g., the charge of the gate 90B is shared with the gate 90C). Accordingly, the activation lines B 84 and C 86 may be driven to a voltage between a logic low voltage and a logic high voltage (e.g., midway point) where the gates 90B and 90C are not activated. The activation line A 82 is driven to a logic low voltage so that the gate 90A is not activated. Because none of the gates 90A, 90B, and 90C are activated, data provided by the data line driver A 78 is not provided to one of the data lines 62.

At the time 182, the switches SWH_C 142, SWL_B 146, SWG_B 152, and SWG_C 154 transition from an open position to a closed position where they remain until a time 184. The switches SWH_B 140, SWL_C 148, and SWI_C 164 transition from a closed position to an open position where they remain until the time 184. Furthermore, between times 182 and 184, the switches SWH_A 138, SWI_A 156, and SWI_B 160 are all open, while the switches SWL_A 144 and SWG_A 150 are all closed. Moreover, the activation line C 86 is driven to a logic high voltage to activate the gate 90C. Because of the charge sharing from the gate 90B, the voltage applied to the activation line C 86 changes from the midway point to the logic high voltage rather than changing from the logic low voltage to the logic high voltage. Therefore, the voltage swing used to drive the gate 90C is reduced.

In certain embodiments, the voltage swing to drive the gate 90C may be reduced by approximately 50% (e.g., reduced in half). Moreover, in some embodiments, the charge sharing between the gates 90B and 90C may reduce power for driving the activation line C 86 by approximately 50%. In other embodiments, the charge sharing between the gates 90B and 90C may reduce power for driving the activation line C 86 by a factor of four. Accordingly, the power consumption of the demultiplexer 76 may be reduced, thereby reducing power consumption of the display 12. The activation lines A 82 and B 84 are driven to a logic low voltage so that the gates 90A and 90B are not activated. With the gate 90C active, data provided by the data line driver A 78 is provided to the data line 62C. For example, data for a blue pixel may be provided between the time 182 and the time 184. The pattern described between times 172 and 184 then repeats throughout operation.

By sharing a charge from a gate of one transistor with a gate of another transistor, power used to activate the gates may be reduced. Accordingly, using such techniques power consumption of the demultiplexer 76 may be reduced, thereby reducing power consumption of an electronic device 10 having the demultiplexer 76. It should be noted that even though the embodiments described herein have been generally described as sharing charges between gates of TFTs of a demultiplexer, the techniques, methods, and devices described herein may also be applied to sharing charges between gates of TFTs of any suitable electronic component or device.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A method comprising:

activating a first gate of a demultiplexer using driving circuitry;

breaking a first connection between the driving circuitry and the first gate after activating the first gate;

making a second connection between the first gate and a second gate of the demultiplexer after activating the first gate to share a first charge stored by the first gate with the second gate;

activating the second gate using the driving circuitry;

making a third connection between the driving circuitry and the second gate;

breaking the third connection between the driving circuitry and the second gate after activating the second gate; and making a fourth connection between the second gate and a third gate of the demultiplexer after activating the second gate to share a second charge stored by the second gate with the third gate.

2. The method of claim 1, comprising making the first connection between the driving circuitry and the first gate before activating the first gate.

3. The method of claim 1, comprising breaking the second connection between the first gate and the second gate after the first charge is shared between the first gate and the second gate.

4. The method of claim 1, wherein making the second connection between the first gate and the second gate of the demultiplexer comprises closing a switch.

5. An electronic display comprising:

a demultiplexer comprising a first transistor, a second transistor, and a third transistor;

a first switch coupled between a first gate of the first transistor and a second gate of the second transistor, the first switch being configured to selectively connect the first gate to the second gate;

a second switch coupled between the second gate of the second transistor and a third gate of the third transistor, the second switch being configured to selectively connect the second gate to the third gate;

driving circuitry configured to control the first switch to connect the first gate to the second gate to share a first charge stored on the first gate with the second gate, and to control the second switch to connect the second gate to the third gate to share a second charge stored on the second gate with the third gate; and a third switch coupled between the third gate of the third transistor and the first gate of the first transistor, wherein the third switch being configured to selectively connect the third gate to the first gate.

6. The electronic display of claim 5, wherein the driving circuitry is configured to control the third switch to connect the third gate to the first gate to share a third charge stored on the third gate with the first gate.

7. The electronic display of claim 5, comprising a third switch coupled between the driving circuitry and the first gate, and a fourth switch coupled between the driving circuitry and the second gate, the third switch being configured to selectively connect the first gate to the driving circuitry and the fourth switch being configured to selectively connect the second gate to the driving circuitry.

8. The electronic display of claim 7, wherein the driving circuitry is configured to control the third switch to connect the first gate to the driving circuitry, and to control the fourth switch to connect the second gate to the driving circuitry.

9. A method comprising:

selectively coupling a first gate of a first transistor of a demultiplexer of an electronic display to a second gate of a second transistor of the demultiplexer of the electronic display via a first switch;

charging the second gate using the first gate while the first gate is coupled to the second gate to reduce power consumption of the electronic display;

selectively coupling the second gate of the second transistor to a third gate of a third transistor of the demultiplexer via a second switch;

charging the third gate using the second gate while the second gate is coupled to the third gate; and selectively coupling the third gate of the third transistor to the first gate of the first transistor of the demultiplexer via a third switch.

10. The method of claim 9, wherein selectively coupling the first gate of the first transistor of the demultiplexer to the second gate of the second transistor of the demultiplexer comprises controlling the first switch to connect the first gate to the second gate.

11. The method of claim 9, wherein selectively coupling the first gate of the first transistor of the demultiplexer to the second gate of the second transistor of the demultiplexer comprises controlling the first switch to disconnect the first gate from the second gate.

12. The method of claim 9, wherein charging the second gate using the first gate comprises sharing a stored charge between the first gate and the second gate.

13. A method comprising:

activating a first gate of a first transistor of a demultiplexer of an electronic display using driving circuitry;

connecting the first gate of the first transistor to a second gate of a second transistor of the demultiplexer of the electronic display using the driving circuitry after activating the first gate to share a first stored charge between the first gate and the second gate;

disconnecting the first gate from the second gate using the driving circuitry;

activating the second gate using the driving circuitry;

connecting the second gate of the second transistor to a third gate of a third transistor of the demultiplexer of the electronic display using the driving circuitry after activating the second gate to share a second stored charge between the second gate and the third gate;

disconnecting the second gate from the third gate using the driving circuitry;

activating the third gate using the driving circuitry;

connecting the third gate to the first gate using the driving circuitry after activating the third gate to share a third stored charge between the third gate and the first gate; and disconnecting the third gate from the first gate using the driving circuitry;

wherein the electronic display comprises a first plurality of switches configured to selectively couple the first gate and the second gate, the second gate and the third gate, and the third gate and the first gate.

14. The method of claim 13, wherein activating the first gate of the first transistor of the demultiplexer using the driving circuitry comprises connecting the first gate to the driving circuitry.

15. The method of claim 13, comprising disconnecting the first gate from the driving circuitry after activating the first gate.

16. The method of claim 13, wherein disconnecting the first gate from the second gate using the driving circuitry comprises opening a switch coupled between the first gate and the second gate.

17. An electronic device comprising:

a processor; and an electronic display comprising a demultiplexer having a first transistor, a second transistor, and a third transistor, wherein the electronic display is configured to store a first charge on a first gate of the first transistor, share the first charge between the first gate of the first transistor and a second gate of the second transistor, store a second charge on the second gate, share the second charge between the second gate of the second transistor and a third gate of the third transistor, store a third charge on the third gate, and share the third charge between the third gate of the third transistor and the first gate of the first transistor, wherein the electronic display comprises a first plurality of switches configured to selectively couple the first gate and the second gate, the second gate and the third gate, and the third gate and the first gate.

18. The electronic device of claim 17, wherein the electronic display comprises driving circuitry configured to drive the first, second, and third gates.

19. The electronic device of claim 18, wherein the electronic display comprises a second plurality of switches configured to selectively couple the first, second, and third gates to the driving circuitry.

* * * * *